United States Patent [19]

Negishi et al.

[11] 4,019,899

[45] Apr. 26, 1977

[54] EROSION-RESISTANT MATERIALS

[75] Inventors: Akira Negishi; Kiyoshi Takayanagi; Masaru Ikeda; Shinji Kousaka, all of Tokyo, Japan

[73] Assignee: The Furukawa Electric Co., Ltd., Tokyo, Japan

[22] Filed: Aug. 1, 1974

[21] Appl. No.: 493,846

Related U.S. Application Data

[63] Continuation-in-part of Ser. No. 151,068, June 8, 1971, abandoned.

[30] Foreign Application Priority Data

June 11, 1970 Japan ..... 45-50454

[52] U.S. Cl. ..... 75/134 F; 75/170; 75/175.5

[51] Int. Cl.[2] ..... C22C 14/00; C22C 19/02

[58] Field of Search ..... 75/170, 134 F, 175.5

[56] References Cited

UNITED STATES PATENTS

| | | | |
|---|---|---|---|
| 3,558,369 | 1/1971 | Wang et al. | 75/175.5 X |
| 3,660,082 | 5/1972 | Negishi et al. | 75/170 X |
| 3,753,700 | 8/1973 | Harrison et al. | 75/175.5 X |

FOREIGN PATENTS OR APPLICATIONS

| | | | |
|---|---|---|---|
| 2,106,687 | 9/1971 | Germany | 75/170 |

*Primary Examiner*—Arthur J. Steiner
*Attorney, Agent, or Firm*—Toren, McGeady and Stanger

[57] ABSTRACT

The disclosed erosion-resistant and wear-resistant Ti-Ni-$M_1$ alloy contains 42.5 to 54.5 atomic percent of titanium, $M_1$ being at least one of Ta, Nb, W, Hf and Mn, the ratio of the atoms of $M_1$ to the total atoms other than Ti being 1 to 55%.

3 Claims, 1 Drawing Figure

EROSION-RESISTANT MATERIALS

CROSS-REFERENCE TO PRIOR APPLICATION

This is a continuation-in-part of copending application Ser. No. 151,068 filed June 8, 1971, now abandoned.

SUMMARY OF THE INVENTION

The present invention relates to materials having excellent slidable property and erosion resistance to be used as parts of machine and equipments, more particularly relates to an intermetallic compound type N-Ti alloy containing 42.5–54.5 atomic % of Ti, one or more of the group consisting of Ta, Nb, W, V, Hf and Mn (herein called $M_1$ group), one or more of the group consisting of Mo, Cr, Fe, Co, Pt, Pd, Rh, Ir, Os and Ru (herein called $M_2$ group) and/or one or more of the group consisting of Al, Zr, Be and Mg (herein called $M_3$ group) with the balance being Ni.

The materials for sliding parts of this invention satisfy all the requirements for the sliding parts, e.g., excellent resistance to seizing and wear as well as good conformability and non-attacking against the sliding surface of the sliding partner, which can not be all attained with materials hitherto known because these properties are incompatible with each other. The present invention offers a material for sliding parts for universal uses in all branches of the industry including sporting goods and business instruments.

The material for sliding parts according to the present invention has excellent resistance to seizing and wear, as well as conformability and non-attacking against the sliding surface of the sliding partner.

As for the material used for the sliding parts of various industrial instruments, the following characteristics are required in general:

1. It hardly seizes.
2. It has a high resistance to wear.
3. It is conformable with the shape of sliding surface of the sliding partner, and does not attack it.

However, as these characteristics are incompatible with each other, materials hitherto known for use for sliding parts could not have all of them, and this has been their inevitable defect.

As for the material for sliding parts, hard metals having a high hardness, e.g., hard chromium and molybdenum, alloys, e.g., steels, stainless steels, hastelloy and stellite, as well as super-hard materials, consisting mainly of wolfrom carbide, and ceramics consisting mainly of alumina, so far been used. However, alloys such as stainless steel and hastelloy above mentioned, though excellent in said characteristic 3, are not satisfactory in points of 1 and 2 above, because they are soft, The super-hard materials, ceramics and the like are hard and therefore excellent in 1 and 2, but remarkably inferior in 3 because they lack plasticity. Metals such as hard chromium and molybdenum have not any particularly remarkable defects, but are unsatisfactory in any of 1, 2 and 3.

As the known materials for sliding parts can not sufficiently satisfy all said requirements, they should be selected according to the purposes of their use, and no material for sliding parts for universal use has not yet been developed.

On the other hand, materials for parts of machines and equipments used in transportation or separation systems for handling gases, liquids or slurries flowing at a high velocity, such as various types of pressure-reducing valves, control valves, pumps, cyclones, super-decantors etc., are required to have excellent erosion resistance, and various special steels, titanium alloys, stellites, etc., have so far been used for such purposes.

However, the difficulty is that although these conventional materials show excellent erosion resistance under specific service conditions, they are very easily attached under different service conditions. Thus up to now no metallic materials which show excellent erosion resistance in a wide range of service conditions have been developed. For example, although hard materials such as stellites and titanium alloys are less susceptible to erosion by low-velocity fluids, they are severely-attacked by a high-velocity fluids, and remarkable erosion is seen when the fluids contains fine solid particles.

In order to overcome the above difficulty, it has been recently proposed to form on the material surface a film composed of ceramics such as alumina and chromium oxide or of hard substances such as tangsten carbide. However, most of such films in spite of their very high hardness lock completely ductility hand have a very small coefficient of expansion as compared with the material alloys so that the films are very susceptible to heat cracking which readily permits the fluids such as liquids chemicals to penetrate into the materials inservice. The films which are formed mainly by flame spray or the like are generally very porous and fluids such as liquids chemicals can easily penetrate into the materials through the pores.

Thus the boundary between the film and the base material is attacked and the film peels; off very often, and such peeling-off of the film causes non-uniform attack on the base material at the peeling-off portions, and, what is worse, broken pieces of the peeled-off film severely attack sliding portions of the machines and equipments and reduce their considerably.

The present invention has been completed through extensive studies and experiments to overcome the above defects of conventional erosion-resistant materials, and one of the objects of the present invention is to provide a multiple-purposed erosion-resistant material useful in a wide range of service conditions.

Another object of the present invention is to provide an erosion-resistant material which is free from deposition of slurry on its surface and yet shows excellent erosion resistance when used in the slurry transportation system.

Still another object of the present invention is to provide a material which when used for heat-exchange piping for conversion of sea-water into fresh water for example, shows excellent erosion resistance and makes water vapour condense drop-wise on the pipe surface, thereby preventing decrease in heat-exchanging efficiency.

The present invention is a achieved in eliminating the foregoing various defects occurred in conventional sliding parts as well as erosion-resistant parts as a results of our repeated studies with devotion, and one of the main objects of the present invention lies in to provide an alloy with excellent slidability applicable to extensive service conditions for practical use in general.

The other objects of the present invention is to provide an alloy having excellent slidability endurable to extensive service condition for practical use in general.

Another object of the present invention is to provide erosion-resistant materials which are free from deposition of slurry on the surface thereof, moreover which show extremely excellent property of erosion resistance in case of being employed to the slurry transportation system.

Further object of the present invention is to provide materials which not only exhibits erosion resistance in applications such as, for instance, pipes of heat exchanger for sea-water or fresh water, but also enhance heat exchangeability considerably by condensing water vapour to drops of water on the pipe surface.

In other words, according to the present invention it is possible to obtain materials with excellent slidability and erosion resistance produced by replacing 1–55 atomic % of Ni atom combined in an alloy comprising 42.5–54.5 atomic % of Ti and the remainder Ni, with one or more of the $M_1$ group or the $M_1$ and $M_2$ groups, or further, if necessary, replacing up to 30 atomic % of Ti atom of the alloy with $M_3$.

BACKGROUND OF THE INVENTION

The present inventors have found the following facts after various studies and experiments for the alloy having the compositions hereinbefore described on the mechanical, chemical and acid properties respectively:

1. In combination of alloys having identical compositions with each other or in combination of an alloy with a metal having different quality, or further in combination of an alloy with an alloy having different compositions, it hardly occurs quickly the phenomenon of siezure of the mating surfaces of mutually sliding parts in the present invention as compared with the combination case, such as of conventional metals or alloys having identical or different compositions.

2. The alloy produced by the present invention have an extraordinary wear resistance for better than the hitherto known metals or alloys having a similar level of hardness, as well as adaptability in fitting to the shape of the mating surfaces of mutually sliding parts, in case of sliding action of the parts so that close contact on the whole mating surfaces thereof can be maintained and wearing of the other mating metal surface is prevented.

Furthermore, the present inventors have found the following facts in the aforementioned alloy after studies on the fluid abrasion:

1. It hardly occurs erosion in the present inventive alloy as compared with conventional materials;

2 When the vapor is sprayed or attached on the cooled surface of the above-mentioned alloy, the vapour is condensed thereon forming in the drop form not in the film form.

Therefore, the aforementioned properties are most seriously desired for sliding parts and erosion resistant materials.

Figure 1:
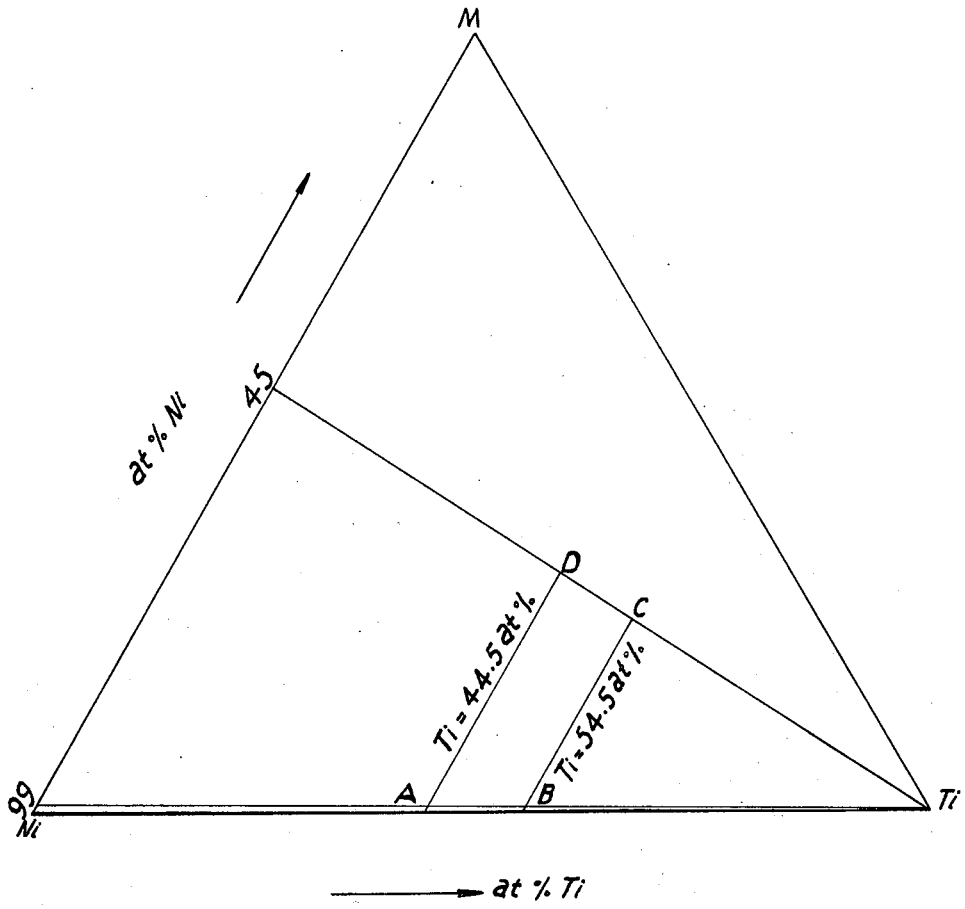
FIG. 1 is a constitutional diagram of a Ti-M-Ni ternary alloy system.

As elucidated hereinbefore, materials according to the present invention are the alloy comprising intermatallic compound Ni-Ti as the main component, and will now be described more in detail with reference to the accompanying drawings.

In the drawings, $M = M_1$ or $M_1 + M_2$.

FIG. 1 is a constitutional diagram of Ti-M-Ni ternary alloy system in which the composition range of the invention material lies in a quadrilateral obtained by connecting points A, B, C and D with straight line, wherein the four points denote:

Point A (Ti, 42.5 atomic %; M, 0.58 atomic %; Ni, the remainder)

Point B (Ti, 54.5 atomic %; M, 0.46 atomic %; Ni, the remainder)

Point C (Ti, 54.5 atomic %; M, 25.0 atomic %; Ni, the remainder)

Point D (Ti, 42.5 atomic %; M, 31.6 atomic %; Ni, the remainder)

The reason for replacing 1–55% of Ni atom contained in the alloy comprising 42.5 to 54.5 atomic % of Ti with the balance being Ni by $M_1$ or $M_1 + M_2$ in the material (namely the atomic ratio of $M_1$ or $M_1 + M_2$ being 1–55% of the total atoms of elements other than Ti) according to the present invention are:

1. To prevent harmful transformation which is caused by temperature variation in Ni-Ti binary alloy consisting approximately of the intermetallic compound Ni Ti, and harmful transformation which causes changes in dimensions and shapes through heating after cold working;

2. To improve wear resistance and erosion resistance of the Ni-Ti binary alloy to a great extent; wherein W and Mo are most effective in preventing the above transformations and the effects for the same diminishes in the order of Ta, Nb and Hf, then less in effect of Cr, Mn, Fe and Cr. On the other hand, W is most effective in improving the wear proof and the erosion resistance of $M_1$, and the same effect lowers in the order of Ta, then followed by V, Mn, Hf and Nb. These effects are considerably enhanced under the condition of co-existing with $M_2$.

Now, in the constitutional diagram shown in FIG. 1, a harmful brittle intermetallic compound $Ni_3Ti$ precipitates as a secondary phase on the left side of the line AD (below 42.5 atomic % of Ti) and also a harmful brittle intermetallic compound Ni $Ti_2$ precipitates as a secondary phase on the right side of the line BC (beyond 54.5 atomic % of Ti), and these precipitates reduce plasticity peculiar to the intermetallic compound Ni Ti and Ni-Ti binary alloys consisting approximately of intermetallic compound Ni Ti, so that both hot and cold workings become very difficult.

Below the line AB (Ti 42.5–54.5 atomic %, the atomic ratio of Ni to $M_1$ is less than 99 : 1), the effect of replacing, a part of Ni atom hereinbefore described with $M_1$ diminishes, while above the line CD (Ti 42.5–54.5 atomic % the atomic ratio of Ni to $M_1$ is beyond 45 : 55). The properties peculiar to the intermetallic compound Ni-Ti and Ni-Ti alloys consisting approximately of intermetallic compound Ni Ti are weekened, thus plasticity lowers thus causing difficulties in both hot and cold workings.

The present invention is also to provide a material by replacing up to 30% of Ti atom contained in Ti-($M_1$ or $M_1 + M_2$) - Ni alloy by $M_3$. The above displacement by $M_3$ brings about effects for improving anti-seizure property, wear resistance and erosion resistance further. The reason for limiting the ratio of the replacement by $M_3$ to Ti atom less than 30% lies in the fact that plasticity of the alloy is diminished to be resulted in impossibility for carrying out both hot and cold workings in case of displacement by $M_3$ more than 30%, and specially desirable ratio of the replacement is up to 25% of Ti atom by Al, or up to 10% of the Ti atom by Zr, Be and Mg, and up to 10% of the Ti atom by combination of more than one element among Zr, Be and Mg and Al.

Among the foregoing $M_2$ group, the replacement ratio of Ni with Pt, Pd, Ir, Rh, Os and Ru (hereinafter described as elements of the platinum group) is desirable to be up to 5% due to the following reasons.

Addition of each of the aforementioned elements of the platinum group is effective for extremely distinguished improvement in wear resistance of and erosion resistance of the alloy having the composition within the foregoing quadrilateral shape, and up to 5% of the replacement of Ni shows the enhancement in effect for improvement as the increase of the replacement ratio, but more than 5% of the replacement ratio is not recognized peculiarly remarkable improvement in the foregoing properties of the alloy, thereby resulting in considerable high cost of production comparing with the advantage gained by the improved properties.

In order to raise the seizing resistance of the material of this invention, it is desirable to make the Ti content 47–52 atomic %, more preferably 48–51 atomic %, and replace less than 35%, more preferably less than 25% of Ni atoms with $M_1$ to $N_1 + M_2$, and, in case replacement of a part of Ti atoms with $M_3$ is required, further replace less than 20%, more preferably less than 10% of Ti atoms.

In order to increase the workability together with the seizing resistance in the material of this invention, it is desirable to make the Ti content 47–52 atomic % and replaces 1–30% of Ni atoms with $M_1$ or $M_1 + M_2$ in order to improve the workability, resistance to seizing and wear simultaneously, it is desirable to make the Ti content 48–51 atomic %, and replace 1–20% of Ni atoms with $M_1$ or $M_1 + M_2$, and, when necessary, less than 10% of contained Ti atoms with Zr and/or Al. In order to obtain the most excellent characteristics as a material for sliding parts, it is desirable to make the Ti content 48–51 atomic %, and replace 1–20% of Ni atoms with one or more element selected from a group of Cr, Mo, Pt, Pd, Rh, Ir, Os, Rn; or further replace less than 10% of Ti atoms with $M_3$.

It is considered that the reason why the material of this invention has excellent characteristics as a material for sliding parts is that it consists of an intermetallic compound type alloy, whose bonding mode among atoms is substantially different from that of metals and alloys in general. In the case of metals and alloys in general, atoms are combined by the metallic bonding, and therefore, electrons in their electron shall of the atom, being unlocalized around each atom, can move freely in the crystal and maintain a solid form owing to the attraction among these free electrons and regularly arranged metal ions. As the electrons are unlocalized in such a way, the bonding among atoms does not rupture even if the relative positions of atoms are shifted remarkably. It is due to such a mode of bonding that metals and alloys in general have plasticity. As the bonding among atoms is limited to such a mode, the wear resistance and hardness of general metals and alloys have a definite correlation, and generally the higher the hardness, the higher the wear resistance. On the contrary, in the case of the material of this invention, the mode of bonding among atoms it quite different from that of general metals or alloys, and there exits a substantial covalent bonding among atoms besides the bonding by means of free electrons. As a result, the properties of the material of this invention do not follow said correlation between wear resistance and hardness, and the material has, which are not found in metals and alloys in general, many specific characteristics, including the excellent seizing resistance, together with a metallic appearance.

Figure 2:
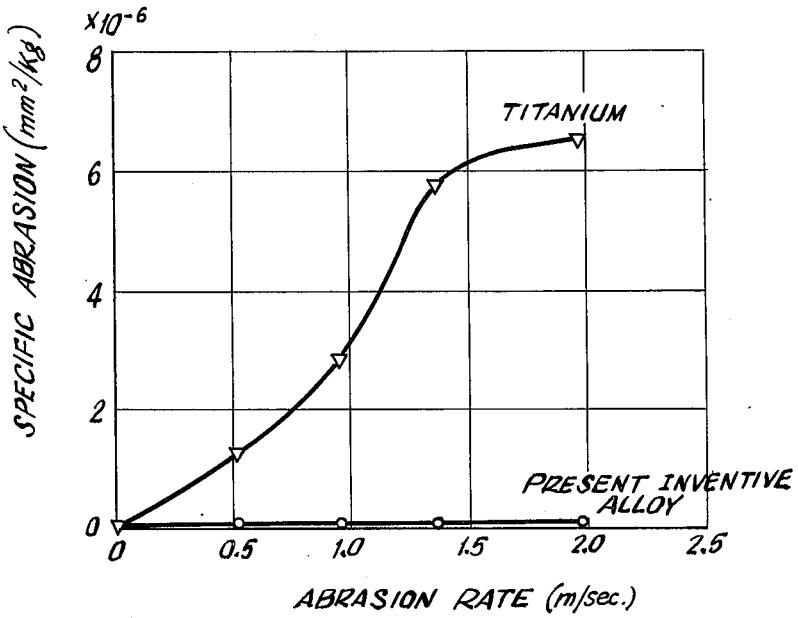
FIG. 2 is a comparison graph of an abrasion test.

FIG. 2 is the result of abrasion test made by Ohgoshi's tester. The wear resistance of the material of this invention is compared with that of titanium and a stainless steel (SUS 27), both having similar hardness as the present material.

In this test, the mechanism of abrasion changes, with the rotation velocity of the sliding ring, and as shown by the curve for titanium, along with the increase of rotation velocity, moves from an "oxidation abrasion" region with a slow increase to a "bright surface abrasion" region with a steep slope, and again to a "melting abrasion" region with a gentle slope. It is clear that the material of this invention does not yet reach, within the velocity range in FIG. 2, to a bright surface abrasion region, namely, to a region where the surface of the material is torn off by direct contact with the sliding ring.

This increase of the rotation velocity relates to the temperature rise of the friction surface, and it is admitted that the mechanism of the bright surface abrasion is identical with the mechanism of seizing. Therefore, the result in FIG. 2 shows that the material of this invention is far less likely to seize than the usual materials, and this material can be used under a severer condition. It is considered that such an outstanding wear resistance is due to the existence of a covalent bonding.

The extraordinarily excellent wear resistance of the material of this invention is due to the coexistence of a covalent bonding, whose bonding power is strong enough to give strength to this material, and a metallic bonding which give plasticity. Moreover, another feature of the material of this invention-while it is strong and tough and has a high wear resistance, its sliding surface becomes easily conform to the shape of the sliding surface of the partner material, giving a complete, total surface contact, and the material does not attack the surface of the partner — is due to the fact that the rate of yield strength to rupture strength of this material is very low as compared with that of the usual high strength alloy. These features are also due to the coexistence of the bonds of different kinds.

As the above mentioned, by replacing, in a Ni-Ti binary alloy with a composition near an intermetallic compound Ni-Ti, 1–45% of contained Ni atoms with $M_1$ or $M_1 + M_2$, or further replacing less than 30% of contained Ti atoms, with N, the phenomenon of transformation induced by the temperature change — whose existence changes remarkably the physical and mechanical properties in the temperature range of its usage, and becomes the cause of the change of measure and shape on heating after cold working — is prevented, and resistance to seizing and wear as well as the conformability and non-attacking against the sliding surface of the partner are improved remarkably, without injuring the hot and cold workability. The material of this invention satisfies all the important requirements for the material for sliding parts, and its outstanding characteristics are due to a peculiar type of bonding. The material is fitted for universal use, which could not be attained in the conventional materials.

Moreover, intermetallic compounds and materials containing intermetallic compound as a main constituent are generally hard and brittle, lacking ductility and mallcability in most cases, and therefore, their plastic working is impossible. Their use is limited only to such applications as magnets, semiconductors, etc., where their peculiar characteristics are utilized, and they are but scarcely used for instruments and parts requiring mechanical and chemical properties. On the contrary, although the material for sliding parts of this invention consists of an intermetallic compound as a main constituent, it has an extraordinarily high plasticity, and can be easily worked into sliding parts of any desired shape such as bar, disc, ring, sleeve, etc., by various manners of cutting, not to mention, hot- or cold-plastic-working by press, hammer, rolls, and so forth. The material for sliding parts of this invention can therefore be manufactured at a cost equal to or lower than that of any known materials for sliding parts, and yet it is far superior in characteristics as above mentioned.

The other reason for obtaining excellent erosion resistance in materials according to the present invention is originated from the followings:

In general, in frictions between solids, there is, roughly speaking, a linear correlation between hardness and wear resistance, and the harder is the material, the higher is its wear resistance.

But in case of contacts between solid and fluid, the above correlation is not found, and even if the material is hard, several erosion often takes place.

The reason why the relation between erosion and hardness differs from that between wear and hardness is explained as under.

Erosion is a kind of wear between fluids and solid, and thus materials in which bonding power of atoms is stronger show higher erosion resistance.

Now the bonding power of atoms has a close relation with hardness of the material, and since a larger bonding power gives higher hardness, it can be said from the point of hardness only that harder materials show higher erosion resistance.

However, erosion resistance not only depends on hardness, but is remarkably influenced by the strength of atom bondage as well as by material properties which alleviate impact given by fine particles in a high-velocity fluid or slurry.

If the hardness of materials is same and the rigidity is different, materials having a larger rigidity are given larger on their surface atoms impact from solids particles of fluids or slurries, thus, the surface atoms being easily taken off with the resultant low erosion resistance. So far as rigidity is concerned, lower rigidity is desirable, and concludingly materials having high hardness but low rigidity are desirable.

The excellent erosion resistance of the inventive materials is attributed to the fact that rigidity of the materials is low in spite of then hardness or rupture strength, and valves of hardness/rigidity or rupture strength/rigidity are remarkably high as compared with those of ordinary metals and alloys.

To show advantages of the present inventive materials tensile strength. Young's modulus and tensile strength/Young's modulus of the present inventive material are shows in Table 1 in composition with those of various conventional alloys used in chemical plants.

Table 1

| | Materials | Tensile Strength (kg/mm²) | Young's Modulus (kg/mm²) | Tensile Strength/ Young's Modulus |
|---|---|---|---|---|
| Conventional Alloys | Ti-6 at % Al-r at % V | 98 | 11,200 | $8.8\times10^{-3}$ |
| | Stellite | 70 | 22,500 | 3.1 " |
| | High Tensile Strength Steel | 105 | 22,100 | 5.0 " |
| | 51Ni-49Ni | 96 | 8,160 | |
| | 40Ni-7Co-1Mo-Ti | 92 | 7,910 | 11.6 " |
| Inventive Materials | 47.5Ni-2.5 Nb-50Ti | 79 | 6,320 | $12.5\times10^{-3}$ |
| | 45Ni-5Nb-50Ti | 88 | 6,820 | 12.9 " |
| | 47.5Ni-2.5Ta-50Ti | 82 | 6,410 | 12.8 " |
| | 45Ni-5Ta-50Ti | 89 | 6,590 | 13.5 " |
| | 47.5Ni-2.5W-50Ti | 90 | 7,630 | 11.8 " |
| | 45Ni-5V-5bTi | 82 | 6,120 | 13.4 " |
| | 45Ni-5%-50Ti | 80 | 6,110 | 13.1 " |
| | 47.5Ni-2.5Hf-50Ti | 89 | 7,300 | 12.2 " |
| | 47.5Ni-1.5Ta-1Mo-50Ti | 95 | 6,930 | 13.7 " |
| | 47.5Ni-1.5V-1Mo-50Ti | 87 | 6,440 | 13.5 " |

As clearly understood from Table 1, the present inventive materials are very high in tensile strength/Young's modulus and shown distinguished excellence as an erosion-resistant material.

Thus the inventive materials can be easily hot-and cold-worked and show excellent erosion resistance in a wider range of service conditions, and the inventors have further found that the materials of the present invention, when used in slurry transportation systems, show that slurry does not adhere at all to the surface of parts made of the inventive materials.

This advantage is due to the fact that the surface of parts made of the inventive materials is not attacked in spite of a long period of service because of excellent erosion resistance of the material, and maintains very high smoothness both microscopically and macroscopically.

For this reason, when the inventive material is used in pipes for heat-exchangers and the like, heat-exchange efficiency does not lower and yet plant operation need not be suspended for slurry removal, thus greatly improving plant efficiency.

Still further advantage of the present invention is that when heat-exchanger pipes for conversion of sea water into fresh water for example are made of the inventive material, water vapour condenses in drop-form on the surfaces of the pipes.

Such condensation of water vapour in drop-form is remarkably advantageous in respect to the heat-exchanging efficiency of pipes, as compared with condensation is film born. Thus the present inventive materials are very excellent as heat-exchanger material.

This drop-form condensation characteristic depends on the relation between the surface tension of the condensed liquid and the affinity between the liquid and the surface on which the liquid condenses, and is apt to accur when such affinity is smaller than the surface tension of the liquid.

The surface of articles made the inventive material is covered by a thin film composed mainly of $TiO_2$ and NiO, and the excellent drop-form condensation characteristic of the inventive material is considered to be due to the fact that the affinity for water of this film is much smaller than that of the surfaces of articles made of ordinary metals and alloys.

Examples of the present invention will be described under.

Table 2

| | Alloys | Tensile Strength (Kg/mm²) | Yield Strength(σ0.2) (Kg/mm²) | Yield Strength/ Tensile Strength |
|---|---|---|---|---|
| Conventional Alloys | Ti-6 at% Al -4 at% V | 98 | 91 | 0.93 |
| | Stellite | 70 | 57 | 0.81 |
| | High Tensile Strength Steel | 105 | 93 | 0.87 |
| | 42.5Ni-6.5Fe-1Mo-50Ti | 123 | 63 | 0.51 |
| | 42.5Ni-1.5Fe-1Mo-50Ti | 95 | 54 | 0.57 |
| | 40Ni-9Co-1Mo- Ti | 92 | 48 | 0.52 |
| | 51Ni - 49 Ti | 96 | 53 | 0.55 |
| Inventive Alloys | 47.5Ni-25Nb-50Ti | 79 | 39 | 0.49 |
| | 45Ni-5.0Nb-50Ti | 88 | 41 | 0.47 |
| | 40Ni-10Nb-50Ti | 101 | 46 | 0.46 |
| | 47Ni-2.5Nb-48.5Ti | 109 | 55 | 0.50 |
| | 47.5Ni-2.5Ta-50Ti | 82 | 39 | 0.48 |
| | 45Ni-5.0Ta-50Ti | 89 | 41 | 0.46 |
| | 40Ni-10Ta-50Ti | 104 | 47 | 0.45 |
| | 49Ni-2.5Ta-48.5Ti | 112 | 58 | 0.52 |
| | 49Ni-1W-50Ti | 79 | 39 | 0.49 |
| | 47.5-2.5W-50Ti | 90 | 44 | 0.49 |
| | 45Ni-5.0W-50Ti | 109 | 51 | 0.47 |
| | 50.5Ni-1.0W-48.5Ti | 107 | 51 | 0.48 |
| | 47.5Ni-2.5V-50Ti | 77 | 38 | 0.47 |
| | 45Ni-5.0V-80Ti | 82 | 39 | 0.47 |
| | 40Ni-10V-50Ti | 93 | 43 | 0.46 |
| | 37.5Ni-12.5V-50Ti | 96 | 43 | 0.45 |
| | 49Ni-2.5V-48.5Ti | 106 | 52 | 0.49 |
| | 46Ni-2.1V-51.5Ti | 102 | 48 | 0.47 |
| | 47.5Ni-2.5Mn-50Ti | 80 | 38 | 0.48 |
| | 45Ni-5Mn-50Ti | 88 | 42 | 0.48 |
| | 47.5Ni-75Hj-50Ti | 89 | 45 | 0.50 |

Table 3

| | Composition (at %) | | | | | | | | | | | | | | | | | | | | | | | Specific Wear Rate (mm²/Kg)×10⁸ | |
|---|---|---|---|---|---|---|---|---|---|---|---|---|---|---|---|---|---|---|---|---|---|---|---|---|---|
| | Ni | Ta | Nb | W | V | Hf | Mn | Mo | Cr | Fe | Co | Ti | Al | Zr | Be | Mg | Pt | Pd | Rh | Ir | Os | Ru | | Wear Rate 1.4m/Sec. | Wear Rate 3.6m/Sec |
| Inventive Alloys | 45 | 5 | | | | | | | | | | 50 | | | | | | | | | | | | 2.1 | 28 |
| | 40 | 10 | | | | | | | | | | 50 | | | | | | | | | | | | 1.7 | 20 |
| | 50 | 2.0 | | | | | | | | | | 48.0 | | | | | | | | | | | | 1.6 | 21 |
| | 47.5 | 2.5 | | | | | | | | | | 50 | | | | | | | | | | | | 2.2 | 35 |
| | 47.5 | 1.5 | | | | | | 1 | | | | 50 | | | | | | | | | | | | 1.8 | 18 |
| | 47.5 | 1.5 | | | | | | | 1 | | | 50 | | | | | | | | | | | | 1.7 | 21 |
| | 35 | 1.5 | | | | | | | | 13.5 | | 50 | | | | | | | | | | | | 2.0 | 42 |
| | 33.5 | 1.5 | | | | | | | | | 15 | 50 | | | | | | | | | | | | 2.1 | 18 |
| | 47.5 | 1.5 | | | | | | 1 | | | | 47.5 | 2.5 | | | | | | | | | | | 1.6 | 15 |
| | 47.5 | 1.5 | | | | | | 1 | | | | 47.5 | | 2.5 | | | | | | | | | | 1.6 | 13 |
| | 47.5 | 1.5 | | | | | | 1 | | | | 47.5 | | | 2.5 | | | | | | | | | 1.7 | 13 |
| | 47.5 | 1.5 | | | | | | 1 | | | | 47.5 | | | | 2.5 | | | | | | | | 1.8 | 16 |
| | 47.5 | 1.5 | | | | | | 1 | | | | 47.5 | 1.5 | 1 | | | | | | | | | | 1.5 | 9 |
| | 47.5 | | 2.5 | | | | | | | | | 50 | | | | | | | | | | | | 2.4 | 41 |
| | 47.5 | | 1.5 | | | | | 1 | | | | 50 | | | | | | | | | | | | 1.9 | 25 |
| | 45 | | 5 | | | | | | | | | 50 | | | | | | | | | | | | 2.2 | 33 |
| | 40 | | 10 | | | | | | | | | 50 | | | | | | | | | | | | 1.9 | 27 |
| | 47.5 | | | 2.5 | | | | | | | | 50 | | | | | | | | | | | | 1.8 | 22 |
| | 47.5 | | | 1 | | | | 1.5 | | | | 50 | | | | | | | | | | | | 1.6 | 12 |
| | 50.5 | | 2.5 | | | | | | | | | 47 | | | | | | | | | | | | 1.7 | 23 |
| | 47.5 | 2.5 | | | | | | | | | | 40 | 5.0 | 5.0 | | | | | | | | | | 2.0 | 25 |
| | 47.5 | | | 1 | | | | | 1.5 | | | 50 | | | | | | | | | | | | 1.6 | 14 |
| | 49 | | | 1 | | | | | | | | 50 | | | | | | | | | | | | 2.0 | 32 |
| | 45 | | | 5 | | | | | | | | 50 | | | | | | | | | | | | 1.8 | 22 |
| | 50.5 | | | 1.0 | | | | | | | | 48.5 | | | | | | | | | | | | 1.7 | 25 |
| | 35 | | | 1 | | | | | | 14 | | 50 | | | | | | | | | | | | 1.7 | 31 |
| | 33.5 | | | 1 | | | | | | | 15.5 | 50 | | | | | | | | | | | | 1.6 | 17 |
| | 47.5 | | | 1 | | | | 1.5 | | | | 47.5 | 1.5 | | 1 | | | | | | | | | 1.6 | 10 |
| | 47.5 | | | | 2.5 | | | | | | | 50 | | | | | | | | | | | | 2.2 | 38 |
| | 45 | | | | 5 | | | | | | | 50 | | | | | | | | | | | | 2.2 | 30 |
| | 40 | | | | 10 | | | | | | | 50 | | | | | | | | | | | | 1.7 | 24 |
| | 35 | | | | 15 | | | | | | | 50 | | | | | | | | | | | | 1.7 | 21 |
| | 30 | | | | 20 | | | | | | | 50 | | | | | | | | | | | | 1.5 | 18 |
| | 45 | | | | 2.5 | | | | | | | 52.5 | | | | | | | | | | | | 2.0 | 32 |

Table 3-continued

| Composition (at %) | | | | | | | | | | | | | | | | | | | | | | | Specific Wear Rate (mm²/Kg)×10⁸ | |
|---|---|---|---|---|---|---|---|---|---|---|---|---|---|---|---|---|---|---|---|---|---|---|---|---|
| Ni | Ta | Nb | W | V | Hf | Mn | Mo | Cr | Fe | Co | Ti | Al | Zr | Be | Mg | Pt | Pd | Rh | Ir | Os | Ru | Wear Rate 1.4m/Sec. | Wear Rate 3.6m/Sec |
| 47.5 | | | | 1.5 | | | 1 | | | | 50 | | | | | | | | | | | 1.8 | 23 |
| 47.5 | | | | 1.5 | | | | 1 | | | 50 | | | | | | | | | | | 1.8 | 22 |
| 50 | | | | 2.5 | | | | | | | 47.5 | | | | | | | | | | | 1.5 | 18 |
| 47.5 | | | | | 2.5 | | | | | | 50 | | | | | | | | | | | 2.3 | 37 |
| 45 | | | | | 5.0 | | | | | | 50 | | | | | | | | | | | 2.2 | 31 |
| 45 | | | | | | 5.0 | | | | | 50 | | | | | | | | | | | 2.1 | 29 |
| 40 | | | | | | 10 | | | | | 50 | | | | | | | | | | | 1.8 | 25 |
| 47.5 | | | | | | 1.5 | 1.0 | | | | 50 | | | | | | | | | | | 1.9 | 24 |
| 47.5 | 2.0 | | | | | | | | | | 50 | | | | | | 0.5 | | | | | 2.0 | 29 |
| 47.5 | 2.0 | | | | | | | | | | 50 | | | | | 0.5 | | | | | | 1.9 | 26 |
| 47.5 | 1.0 | | | | | | 1.0 | | | | 50 | | | | | | 0.5 | | | | | 1.5 | 15 |
| 47.8 | 2.0 | | | | | | | | | | 50 | | | | | | | 0.2 | | | | 2.0 | 29 |
| 47.8 | 2.0 | | | | | | | | | | 50 | | | | | | | | 0.2 | | | 2.1 | 33 |
| 47.8 | 2.0 | | | | | | | | | | 50 | | | | | | | | | 0.2 | | 2.0 | 30 |
| 47.8 | 2.0 | | | | | | | | | | 50 | | | | | | | | | | 0.2 | 1.9 | 32 |
| 47.5 | | 2.0 | | | | | | | | | 50 | | | | | | 0.5 | | | | | 2.2 | 36 |
| 47.5 | | | | 2.0 | | | | | | | 50 | | | | | | 0.5 | | | | | 2.1 | 33 |
| Conventional Materials | 35Ni-15Fe-50Ti | | | | | | | | | | | | | | | | | | | | | 2.2 | 55 |
| | 47.5Ni-2.5Mo-50Ti | | | | | | | | | | | | | | | | | | | | | 2.1 | 28 |
| | 47.5Ni-2.5Cr-50Ti | | | | | | | | | | | | | | | | | | | | | 1.9 | 23 |
| | titanium | | | | | | | | | | | | | | | | | | | | | 572 | 763 |
| | Stainless Steel | | | | | | | | | | | | | | | | | | | | | 167 | 198 |
| | Hastelloy C | | | | | | | | | | | | | | | | | | | | | 124 | 180 |
| | Stellite | | | | | | | | | | | | | | | | | | | | | 38 | 85 |
| | Ni-Ti | | | | | | | | | | | | | | | | | | | | | 2.7 | 71 |

As clearly understood from Table 3, materials according to the present invention is excellent in wear resistance as compared with the hitherto conventional materials and is extremely effective for the improvement of wear resistance due to the replacement of Ni atom and one part of Ti atom respectively by $M_1$, $M_2$ and $M_3$.

From the viewpoint of classification in replacement atom from bringing about the foregoing effects. W is most effective among the aforementioned $M_1$ and Ta comes to the next in efficacy, followed by V, Mn, Hf and Nb.

In the second place, referring to the effect originated from the replacement by $M_1$ and $M_2$, remarkable synergestic effect can be obtained, particularly in case of the replacement by Mo and Cr among the Mi metal group. For example, specific wear rate at the friction velocity of 3.6 m for the material produced by replacing 5% of Ni atom, (Corresponds to 2.5% of gold atom) with Ta and Mo is diminished to approximately one half of the amount in case of replacement with Ta only.

Such synergistic effect as mentioned above appears distinctly when elements of the platinum group are employed as $M_2$.

Referring to the effect of the replacement ratio, both cases of replacements by $M_1$ and $M_3$ produce very little difference in respect of oxidation abrasion at a low friction velocity, while in respect of bright surface abrasion at a high friction velocity, the effect of replacement begins to appear at the replacement ratio of 0.5 atomic % and the specific abrasion amount remarkably decreases as the replacement ratio increases up to 30 atomic %.

From the results of the testings of the examples according to the present invention, it is clear that increase of the friction velocity causes increase of the temperature on the friction surface, thus replacement of Ni atom by $M_1$ or $M_1 + M_2$, and further replacement of Ti atom by $M_3$ is found to transfer the temperature which moves from oxidation abrasion to bright surface abrasion towards the side of high temperature.

On the other hand, as explained hereinbefore, the phenomenon of seizure (seizing phenomenon) is meant to be the phenomenon in which the abrasion surface is plucked off by wear and tear and which corresponds to bright surface abrasion. Therefore, replacement of Ni atom by $M_1$ and $M_2$ metals, furthermore replacement of Ti atom by $M_3$ metals are effective for preventing seizure, thus material according to the present invention is almost free from the phenomenon of seizure as compared with conventional materials and is proved to be durable against far severe service conditions.

Table 4

| Combination | Sliding Materials A | B | Wear Rate (mg) A | B | A+B | Sliding Surface Condition A | B |
|---|---|---|---|---|---|---|---|
| Combination of conventional materials | Titanium | Carbon Steel | 394 | 6.5 | 401 | x | |
| | Stainless Steel (SUS 27) | " | 106 | 7.0 | 113 | Δ | Δ |
| | Hastelloy (C) | " | 198 | 6.8 | 205 | Δ | Δ |
| | Stellite | " | 37 | 96 | 133 | | Δ |
| | Titanium | Titanium | 786 | 751 | 1537 | x | x |
| | Stainless Steel (SUS 27) | Stainless Steel (SUS 27) | 285 | 272 | 557 | x | x |
| | Hastelloy C | Hastelloy C | 381 | 394 | 775 | x | x |
| | Stellite | Stellite | 169 | 173 | 342 | Δ | Δ |
| Combination including the present materials | 47.5Ni-2.5Ta-50Ti | Carbon Steel | 3.4 | 5.3 | 8.7 | | |
| | 47.5Ni-1.5Ta-1.0Mo-50Ti | " | 2.0 | 5.2 | 7.2 | | |
| | 33.5Ni-1.5Ta-15Co-50Ti | " | 1.7 | 4.8 | 6.5 | | |

Table 4-continued

| Combination | Sliding Materials A | B | Wear Rate (mg) A | B | A + B | Sliding Surface Condition A | B |
|---|---|---|---|---|---|---|---|
| | 47.5Ni-1.5Ta-1.0Mo-47.5Ti-2.5Be | " | 2.0 | 5.1 | 7.1 | | |
| | 50Ni-2.0Ta-48Ti | " | 1.9 | 5.7 | 7.6 | | |
| | 47Ni-2.0Ta-51Ti | " | 2.3 | 5.4 | 7.7 | | |
| | 45Ni-5Nb-50Ti | " | 2.8 | 5.5 | 8.3 | | |
| | 47.5Ni-2.5W-50Ti47 | " | 2.2 | 6.3 | 8.5 | | |
| | 47.5Ni-1W-1.5Mo-50Ti | " | 1.8 | 6.0 | 7.8 | | |
| | 47.5Ni-1W-1.5Cr-50Ti | " | 1.7 | 5.9 | 7.6 | | |
| | 47.5Ni-1W-1.5Mo-47.5Ti-1.5Al-1Be | " | 1.5 | 6.4 | 7.9 | | |
| | 45Ni-5W-50Ti | " | 1.3 | 6.5 | 78 | | |
| | 45Ni-5V-50Ti | " | 2.1 | 5.2 | 7.3 | | |
| | 30Ni-20V-50Ti | " | 1.5 | 5.9 | 7.4 | | |
| | 47.5Ni-2.5Hf-50Ti | " | 3.0 | 5.6 | 8.6 | | |
| | 45Ni-5Mn-50Ti | " | 2.2 | 5.0 | 7.2 | | |
| | 47.5Ni-2.0Ta-0.5Pd-50Ti | " | 3.1 | 5.2 | 8.3 | | |
| | 47.5Ni-1.0Ta-1.0Mo-0.5Pa-50Ti | " | 2.3 | 5.4 | 7.7 | | |
| | 47.5Ni-2.0Nb-0.5Pa-50Ti | " | 3.4 | 5.1 | 8.5 | | |
| | 47.5Ni-2.0V-0.5Pa-50Ti | " | 2.9 | 5.1 | 8.0 | | |
| | 47.5Ni-2.5Ta-50Ti | " | 3.5 | 3.2 | 6.7 | Δ | |
| | 47.5Ni-1.5Ta-1.0Mo-50Ti | " | 2.8 | 2.7 | 6.5 | | |
| | 33.5Ni-1.5Ta-15Co-50Ti | " | 2.0 | 1.9 | 3.9 | | |
| | 47.5Ni-1.5Ta-1.0Mo-47.5Ti-2.5Be | " | 2.1 | 2.0 | 4.1 | | |
| | 50Ni-2.0Ta-48Ti | " | 2.2 | 2.0 | 4.2 | | |
| | 47Ni-2.0Ta-51Ti | " | 2.2 | 2.4 | 4.6 | | |
| | 45Ni-5Nb-50Ti | " | 3.1 | 3.3 | 6.4 | | Δ |
| | 47.5Ni-2.5W-50Ti | " | 2.3 | 2.5 | 4.8 | | |
| | 47.5Ni-1W-1.5Mo-50Ti | " | 1.7 | 1.8 | 3.5 | | |
| | 47.5Ni-1W-1.5Cr-50Ti | " | 1.9 | 1.7 | 3.6 | | |
| Combination of conventional materials | 33.5Ni-16.5Co-50Ti | " | 2.1 | 4.7 | 6.8 | | |
| | 47.5Ni-2.5Mo-50Ti | " | 2.2 | 5.3 | 7.5 | | |
| | 33.5Ni-16.5Co-50Ti | " | 2.4 | 2.2 | 4.6 | | |
| | 47.5Ni-2.5Mo-50Ti | " | 2.4 | 2.3 | 4.7 | | |
| Combination including the present materials | 47.5Ni-1W-1.5Mo-47.5Ti-1.5Al-1Be | " | 1.6 | 1.7 | 3.4 | | |
| | 45Ni-5W-50Ti | " | 1.5 | 1.4 | 2.9 | | |
| | 45Ni-5V-50Ti | " | 2.3 | 2.5 | 4.8 | Δ | |
| | 30Ni-20V-50Ti | " | 1.7 | 1.5 | 3.2 | | |
| | 47.5Ni-2.5Hf-50Ti | " | 3.5 | 3.2 | 7.7 | Δ | Δ |
| | 45Ni-5Mn-50Ti | " | 2.1 | 2.2 | 4.3 | | |
| | 47.5Ni-2.0Ta-0.5Pd-50Ti | " | 3.2 | 3.2 | 6.4 | | Δ |
| | 47.5Ni-1.0Ta-1.0Mo-0.5Pd-50Ti | " | 2.3 | 2.4 | 4.7 | | |
| | 47.5Ni-2.0Nb-0.5Pd-50Ti | " | 3.6 | 3.7 | 7.3 | Δ | |
| | 47.5Ni-2.0V-0.5Pd-50Ti | " | 3.0 | 3.1 | 6.1 | | |
| | 40Ni-10V-50Ti | " | 1.7 | 5.3 | 7.0 | | |
| | 42.5Ni-7.5W-50Ti | " | 1.2 | 7.2 | 8.4 | | |

As is apparently understood from the results shown Table 4, the materials according to the present invention are not only advantageous for diminishing abrasion remarkably as compared with the conventional materials irrespective of the materials to be combined with the inventive materials, but also effective for diminishing abrasion of the conventional materials to be combined with the inventive materials.

Moreover, the conventional materials have disadvantages of being suffered from violent phenomenon of seizure and thus being confronted with wear and tear as well as terrible roughness on the sliding surfaces thereof when conventional materials comprising the same compositions are subjected to be slid with each other, whereas, in case of materials according to the present invention are adapted to be slid with other inventive materials, phenomenon of seizure hardly occurs.

Replacement for a part of Ni atom in the material according to the present invention by $M_1$ metal or $M_1 + M_2$ metals, and replacement for Ti atom of the inventive material by N respectively are remarkably effective for improving wear resistance and seizing resistance, furthermore from the view point of efficacy for sliding motion of the inventive material with other inventive materials in the classification of elements for replacement, the efficacy of W is most remarkable among the $M_1$ group and V, Mn come to the next and Hf, Ta and Nb follow in sequence.

Referring to the effect of Ni replacement by $M_1$ and $M_2$, extraordinary effect can be obtained by the replacement by $M_1 + M_2$ metals in any combination at the same total replacement ratio as compared with the replacement by $M_1$ alone.

On the other hand, when the inventive material is adapted to be slid in combination with a conventional material, the effect for preventing abrasion of the inventive material itself by replacement seems to be nearly equivalent to that of the case in which the inventive materials are adapted to be slid with each other. However, in view of the offensive property of the inventive material against the other material to be combined therewith, V, Mn are most efficacious, then W is the next to the foregoings, and Ta, Hf and Nb follow.

In the above-mentioned case also, combined effect by $M_1 + M_2$ is remarkable.

Referring to the influence of replacement ratio on abrasion, the higher is the replacement ratio, the more surpassing is wear resistance of the inventive materials in every combination thereof. While in case of subjecting the inventive material to be slid in combination with conventional material, abrasion of the latter at more than 20% of the replacement ratio (more than 10 atomic % in content ratio) is large, thus resulting in enhancing the total abrasion rate.

EXAMPLE 4

Ni, Ti and replacement elements $M_1$ and $M_2$ were melted by high frequency heating under $2 - 5 \times 10^{-4}$mmHg of vacuum degree in a graphite crucible, and cast into ingots as shown in Table 5. Then the above ingots were pressed at about 930° – 400° C and hammered, and formed into valves and valve seats of control valves by machining and used for controlling urea vapour.

For the comparison's sake, similar type of valve parts (valves and valve seats) were made of conventional materials such as Ti (Titanium) and special steel of the like under the same conditions.

Erosions after service are indicated in Table 5.

Further the testing conditions are elucidated as follows:

Temperature of urea vapour : 170° C

Pressure : reduced from 190 to 2 atmospheres

Testing period : 6 months

The symbols marked in the column of "appearance" in the table are based on the following standard:

o : Metallic luster without unevenness and cloudiness

Δ : Somewhat cloudy

□ : Somewhat uneven x : Extremely uneven

Table 5

| Composition (at %) | | | | | | | | | | | | | | | | | | | | | | | Weight Decrease (mg) | Appearance |
|---|---|---|---|---|---|---|---|---|---|---|---|---|---|---|---|---|---|---|---|---|---|---|---|---|
| Ni | Ta | Nb | W | V | Hf | Mn | Mo | Cr | Fe | Co | Ti | Al | Zr | Be | Mg | Pt | Pd | Rd | Ir | Os | Rd | | | |
| Inventive Materials | | | | | | | | | | | | | | | | | | | | | | | | |
| 47.5 | 2.5 | | | | | | | | | | 50 | | | | | | | | | | | | 31 | |
| 45 | 5 | | | | | | | | | | 50 | | | | | | | | | | | | 26 | |
| 40 | 10 | | | | | | | | | | 50 | | | | | | | | | | | | 15 | |
| 50 | 2 | | | | | | | | | | 48 | | | | | | | | | | | | 17 | |
| 47.5 | 1.5 | | | | | | 1 | | | | 50 | | | | | | | | | | | | 19 | |
| 47.5 | 1.5 | | | | | | | 1 | | | 50 | | | | | | | | | | | | 18 | |
| 35 | 1.5 | | | | | | | | 13.5 | | 50 | | | | | | | | | | | | 14 | |
| 33.5 | 1.5 | | | | | | | | | 15 | 50 | | | | | | | | | | | | 16 | |
| 28.5 | 1.5 | | | | | | | | | 20 | 50 | | | | | | | | | | | | 15 | |
| 47.5 | 1.5 | | | | | | 1 | | | | 47.5 | 2.5 | | | | | | | | | | | 13 | |
| 47.5 | 1.5 | | | | | | 1 | | | | 47.5 | | 2.5 | | | | | | | | | | 14 | |
| 47.5 | 1.5 | | | | | | 1 | | | | 47.5 | | | 2.5 | | | | | | | | | 16 | |
| 47.5 | 1.5 | | | | | | 1 | | | | 47.5 | | | | 2.5 | | | | | | | | 15 | |
| 47.5 | 1.5 | | | | | | 1 | | | | 47.5 | 1.5[1] | | | | | | | | | | | 12 | |
| 47.5 | | 2.5 | | | | | | | | | 50 | | | | | | | | | | | | 34 | |
| 47.5 | | 1.5 | | | | | 1 | | | | 50 | | | | | | | | | | | | 21 | |
| 45 | | 5 | | | | | | | | | 50 | | | | | | | | | | | | 26 | |
| 40 | | 10 | | | | | | | | | 50 | | | | | | | | | | | | 19 | |
| 47.5 | | | 2.5 | | | | | | | | 50 | | | | | | | | | | | | 20 | |
| 45 | | | 5 | | | | | | | | 50 | | | | | | | | | | | | 16 | |
| 40 | | | 10 | | | | | | | | 50 | | | | | | | | | | | | 8 | |
| 47.5 | | | 1 | | | | 1.5 | | | | 50 | | | | | | | | | | | | 15 | |
| 50.5 | | 2.5 | | | | | | | | | 47 | | | | | | | | | | | | 11 | |
| 47.5 | 2.5 | | | | | | | | | | 40 | 5.5 | | | | | | | | | | | 10 | |
| 47.5 | | | 1 | | | | | 1.5 | | | 50 | | | | | | | | | | | | 16 | |
| 48 | | | 2 | | | | | | | | 50 | | | | | | | | | | | | 24 | |
| 50.5 | | | 1 | | | | | | | | 48.5 | | | | | | | | | | | | 19 | |
| 35 | | | 1 | | | | | | 14 | | 50 | | | | | | | | | | | | 13 | |
| 33.5 | | | 1 | | | | | | | 15.5 | 50 | | | | | | | | | | | | 15 | |
| 47.5 | | | 1 | | | | 1.5 | | | | 50 | | | | | | | | | | | | 16 | |
| 47.5 | | | | 2.5 | | | | | | | 50 | | | | | | | | | | | | 39 | Δ |
| 45 | | | | 5 | | | | | | | 50 | | | | | | | | | | | | 31 | Δ |
| 40 | | | | 10 | | | | | | | 50 | | | | | | | | | | | | 24 | |
| 35 | | | | 15 | | | | | | | 50 | | | | | | | | | | | | 20 | |
| 30 | | | | 20 | | | | | | | 50 | | | | | | | | | | | | 18 | |
| 45 | | | | 2.5 | | | | | | | 52.5 | | | | | | | | | | | | 33 | Δ |
| 47.5 | | | | 1.5 | | | 1 | | | | 50 | | | | | | | | | | | | 22 | |
| 47.5 | | | | 1.5 | | | | 1 | | | 50 | | | | | | | | | | | | 21 | |
| 50 | | | | 2.5 | | | | | | | 47.5 | | | | | | | | | | | | 18 | |
| 47.5 | | | | | 2.5 | | | | | | 50 | | | | | | | | | | | | 42 | Δ |
| 45 | | | | | 5 | | | | | | 50 | | | | | | | | | | | | 35 | Δ |
| 45 | | | | | | 5 | | | | | 50 | | | | | | | | | | | | 32 | |
| 40 | | | | | | 10 | | | | | 50 | | | | | | | | | | | | 23 | |
| 47.5 | | | | | | 15 | 1 | | | | 50 | | | | | | | | | | | | 21 | |
| 45 | | | 5 | | | | | | | | 50 | 2.5 | 2.5 | | | | | | | | | | 9 | |
| 49.5 | | | | 0.5 | | | | | | | 50 | | | | | | | | | | | | 47 | Δ |
| Conventional Materials | | | | | | | | | | | Titanium | | | | | | | | | | | | 2,343 | × |
| | | | | | | | | | | | Special Steel (Fe-16at%Cr-lat%Si-lat%Mo-0.2at%C) | | | | | | | | | | | | 2,107 | × |
| | | | | | | | | | | | Stellite | | | | | | | | | | | | 386 | |
| | | 45Ni-5Fe-50Ti | | | | | | | | | | | | | | | | | | | | | 30 | Δ |
| | | 40Ni-10Fe-50Ti | | | | | | | | | | | | | | | | | | | | | 28 | Δ |
| | | 49.5Ni-0.5Co-50Ti | | | | | | | | | | | | | | | | | | | | | 29 | Δ |
| | | 45Ni-5Cr-50Ti | | | | | | | | | | | | | | | | | | | | | 23 | |
| | | 47.5Ni-2.5Mo-50Ti | | | | | | | | | | | | | | | | | | | | | 27 | |
| | | 47.5Ni-2.5Cr-50Ti | | | | | | | | | | | | | | | | | | | | | 27 | |
| | | 50Ni-50Ti | | | | | | | | | | | | | | | | | | | | | 51 | × |

From the results shown in Table 5, it is clearly understood that the present inventive materials have very excellent erosion resistance, and the replacement of each of Ni, Ti atoms by $M_1$ and $M_2$ respectively is effective for improving erosion resistance and surface conditions.

In other words, reviewing the above facts from the viewpoint of the replacement elements, W is most efficacious, then Ta comes to the next, followed by V, Mo, Hf and Nb. Thus the most distinguished efficacy can be obtained in case of replacement by combination of $M_1$ and $M_2$ rather than in the case of replacement by $M_1$ or $M_2$ alone.

Furthermore, reviewing the influence of the replacement ratio, remarkable effect for improving erosion resistance is brought about when the replacement ratio is 0.5–30% for each of $M_1$ and $M_2$, but no substantial enhancement in the effect is obtained in case of the replacement ratio is beyond the above-mentioned range.

EXAMPLE 5

The present inventive material was melted, pressed and hammered under the same conditions as in Example 4 to form bar rods, each of which is about 30 mm in diameter and about 1.2 m in length and which was worked into pipes, each of 25 mm in outer diameter, 20 mm in inner diameter and 1 m in length by machining and drilling.

Thus produced pipes were assembled into a heat exchanger for a slurry transportation system. At the end of service periods of 1 month and 2 months, the amount of slurry adhered to the inner wall of the pipe was measured and compared with that measured on pipes of similar size and shape made of conventional materials such as titanium (Ti), special steel, Stellite or the like.

In this instance, the slurry was a mixture of 20% by weight of CO powder and 80% by weight of water, the testing temperature was 120° C and the flow velocity of slurry was 3 m/sec., the results of which are shown in Table 6.

Table 6

| | Composition (at%) | | | | | | | | | | | | | | | | | | | | | | | Amount of Slurry Adhering to Pipe (gr) |
|---|---|---|---|---|---|---|---|---|---|---|---|---|---|---|---|---|---|---|---|---|---|---|---|---|
| | Ni | Ta | Nb | W | V | Hf | Mn | Mo | Cr | Fe | Co | Ti | Al | Zr | Be | Mg | Pt | Pd | Rh | Ir | Os | Ru | | |
| Inventive Materials | 47.5 | 2.5 | | | | | | | | | | 50 | | | | | | | | | | | | 1.75 |
| | 45 | 5 | | | | | | | | | | 50 | | | | | | | | | | | | 1.11 |
| | 40 | 10 | | | | | | | | | | 50 | | | | | | | | | | | | 0.63 |
| | 50 | 2 | | | | | | | | | | 48 | | | | | | | | | | | | 0.47 |
| | 47.5 | 1.5 | | | | | | 1 | | | | 50 | | | | | | | | | | | | 0.81 |
| | 47.5 | 1.5 | | | | | | | 1 | | | | | | | | | | | | | | | 0.79 |
| | 33.5 | 1.5 | | | | | | | | | 15 | 50 | | | | | | | | | | | | 0.60 |
| | 28.5 | 1.5 | | | | | | | | | 20 | 50 | | | | | | | | | | | | 0.58 |
| | 47.5 | 1.5 | | | | | | | 1 | | | 47.5 | 2.5 | | | | | | | | | | | 0.43 |
| | 47.5 | 1.5 | | | | | | | 1 | | | 47.5 | | 2.5 | | | | | | | | | | 0.41 |
| | 47.5 | 1.5 | | | | | | | | | | 47.5 | 1.5 | 1 | | | | | | | | | | 0.38 |
| | 45 | | 5 | | | | | | | | | 50 | | | | | | | | | | | | 1.13 |
| | 48 | | | 2 | | | | | | | | 50 | | | | | | | | | | | | 0.86 |
| | 47.5 | | | 2.5 | | | | | | | | 50 | | | | | | | | | | | | 0.78 |
| | 45 | | | 5 | | | | | | | | 50 | | | | | | | | | | | | 0.54 |
| | 40 | | | 10 | | | | | | | | 50 | | | | | | | | | | | | 0.33 |
| | 50.5 | | 2.5 | | | | | | | | | 47 | | | | | | | | | | | | 0.39 |
| | 47.5 | | | 1 | | | | 1.5 | | | | 50 | | | | | | | | | | | | 0.70 |
| | 47.5 | | | 1 | | | | | 1.5 | | | 50 | | | | | | | | | | | | 0.71 |
| | 47.5 | | | | 2.5 | | | | | | | 50 | | | | | | | | | | | | 1.91 |
| | 47.5 | | | | 1.5 | | | 1 | | | | 50 | | | | | | | | | | | | 0.87 |
| | 47.5 | | | | 1.5 | | | | 1 | | | 50 | | | | | | | | | | | | 0.85 |
| | 45 | | | | 5 | | | | | | | 50 | | | | | | | | | | | | 1.09 |
| | 40 | | | | 10 | | | | | | | 50 | | | | | | | | | | | | 0.92 |
| | 35 | | | | 15 | | | | | | | 50 | | | | | | | | | | | | 0.76 |
| | 30 | | | | 20 | | | | | | | 50 | | | | | | | | | | | | 0.73 |
| | 45 | | | | 25 | | | | | | | 52.5 | | | | | | | | | | | | 0.64 |
| | 45 | | | | | 5 | | | | | | 50 | | | | | | | | | | | | 1.17 |
| | 45 | | | | | | 5 | | | | | 50 | | | | | | | | | | | | 1.09 |
| Conventional Materials | Titanium | | | | | | | | | | | | | | | | | | | | | | | 187 |
| | Special Steel (Fe-16at%Cr-lat%Si-lat%Mo-0.2at%C) | | | | | | | | | | | | | | | | | | | | | | | 109 |
| | Stellite | | | | | | | | | | | | | | | | | | | | | | | 13 |
| | 45Ni-5Fe-50Ti | | | | | | | | | | | | | | | | | | | | | | | 1.04 |
| | 45Ni-5Cr-50Ti | | | | | | | | | | | | | | | | | | | | | | | 0.82 |
| | 47.5Ni-2.5Mo-50Ti | | | | | | | | | | | | | | | | | | | | | | | 0.89 |
| | 47.5Ni-2.5Cr-50Ti | | | | | | | | | | | | | | | | | | | | | | | 0.86 |
| | 50Ni-50Ti | | | | | | | | | | | | | | | | | | | | | | | 2.35 |

From the results shown in Table 6, it is understood that almost no adhesion of slurry is observed in case of the pipe made of the present inventive material, thus the inventive material is much better in exfoliation property against slurry adhesion than the pipe made of conventional materials.

Influence to the above-mentioned exfoliation property by elements constituting alloys and the contents of the elements in the alloy is observed to be nearly the same as in Example 4 and the best efficacy is found to be obtained particularly by combination of $M_1$ with $M_2$.

EXAMPLE 6

Disks of 30 mm diameter and 10 mm thickness were cut from a bar stock of the present inventive material produced in the same way as in Example 4 and the cut surfaces were mirror finished with an emery paper and buffing, and fully degreased. Then water drops were dropped on the ground surfaces to measure the contact angle $\theta$ and the results were compared with those of the conventional materials as shown in Table 7.

Table 7

| | Alloy Compositions | Contact Angle ($\theta$°) |
|---|---|---|
| Inventive Materials | 45Ni-5Ta-50Ti | 25 |
| | 50Ni-2Ta-48Ti | 27 |
| | 47.5Ni-1.5Ta-1Mo-50Ti | 34 |
| | 47.5Ni-1.5Ta-1Mo-47.5Ti-2.5Zr | 36 |
| | 47.5Ni-1.5Ta-1Mo-47.5Ti-2.5Be | 36 |
| | 45Ni-5Nb-5oTi | 31 |
| | 48Ni-2W-50Ti | 33 |
| | 47.5Ni-1W-1.5Mo-50Ti | 37 |
| | 47.5Ni-1W-1.5Mo-50Ti | 36 |
| | 47.5Ni-1W-1.5Mo-47.5Ti-2.5mg | 38 |
| | 45Ni-5V-50Ti | 33 |
| | 45Ni-5Hf-50Ti | 32 |
| | 45Ni-5Mn-50Ti | 32 |
| | 47.5Ni-1.5Mn-1Mo-50Ti | 34 |
| | 47.5Ni-2.0Ta-50Ti-0.5Pd | 35 |
| | Titanium | 4 |
| | Special steel (Fe-16wt.% Cr-1wt.% | 5 |

Table 7-continued

| | Alloy Compositions | Contact Angle ($\theta°$) |
|---|---|---|
| | Si-1wt.% Mo-0.2wt.%C) | |
| | Stellite | 10 |
| Conventional Materials | 45Ni-5Fe-50Ti | 23 |
| | 45Ni-5Mo-50Ti | 27 |
| | 45Ni-5Cr-50Ti | 24 |
| | 45Ni-5Co-50Ti | 26 |

As shown in Table 7, the contant angle $\theta$ is remarkably large in case of the present inventive materials and clearly indicates that the present inventive materials have excellent drop-form condensation characteristic.

EXAMPLE 7

The present inventive materials as shown in Table 8 were worked in a similar way as in Example 1, subjected to sand blasting and acid pickling to remove the surface oxide film and sheet stocks of 1.5 m thickness were prepared. From these sheet stocks, two corrosion test specimens of 30 mm² were prepared for each alloy composition, immersed in an aqueous solution of sulfuric acid and nitric acid at 70° C for 100 hours. Then weight decreases of the specimens were measured to determine the corrosion rate.

At the same time, the same corrosion test was conducted on the conventional materials containing 1.7% of carbon. The results are shown in Table 8. It is clearly understood from Table 8 that the corrosion resistance of the present inventive materials is far better than that of the conventional materials, and that among the present inventive materials, the materials containing platinum metal and molybdenum show excellent corrosion resistance against sulfuric acid, and the materials containing tantalum show excellent corrosion resistance against nitric acid.

Table 8

| | Composition (at.%) | | | | | | | | | | | | | | | | | | | | | | | Corrosion Rate (mm/year) | |
|---|---|---|---|---|---|---|---|---|---|---|---|---|---|---|---|---|---|---|---|---|---|---|---|---|---|
| | Ni | Ta | Nb | W | V | Hf | Mn | Mo | Cr | Fe | Co | Ti | Al | Zr | Be | Mg | Pt | Pd | Rh | Ir | Os | Ru | | 40wt% $H_2SO_4$ | 33% $NHO_3$ |
| Inventive Materials | 45 | 5 | | | | | | | | | | 50 | | | | | | | | | | | | 8.2 | 0.12 |
| | 47.5 | 1.5 | | | | | | 1 | | | | 50 | | | | | | | | | | | | 0.53 | 0.39 |
| | 50 | 2 | | | | | | | | | | 48 | | | | | | | | | | | | 9.8 | 0.30 |
| | 47.5 | 1.5 | | | | | | 1 | | | | 47.5 | | 2.5 | | | | | | | | | | 0.49 | 0.35 |
| | 45 | | 5 | | | | | | | | | 50 | | | | | | | | | | | | 19.5 | 1.57 |
| | 45 | | | 5 | | | | | | | | 50 | | | | | | | | | | | | 12.7 | 1.36 |
| | 47.5 | | | 1 | | | | 1.5 | | | | 50 | | | | | | | | | | | | 0.50 | 1.49 |
| | 47.5 | | | 1 | | | | | 1.5 | | | 50 | | | | | | | | | | | | 11.8 | 1.38 |
| | 45 | | | | 5 | | | | | | | 50 | | | | | | | | | | | | 23.4 | 1.52 |
| | 45 | | | | | 5 | | | | | | 50 | | | | | | | | | | | | 26.6 | 1.71 |
| | 45 | | | | | | 5 | | | | | 50 | | | | | | | | | | | | 24.2 | 1.65 |
| | 35 | 1.5 | | | | | | | | 13.5 | | 50 | | | | | | | | | | | | 2.65 | 0.41 |
| | 33.5 | 1.5 | | | | | | | | | 15 | 50 | | | | | | | | | | | | 2.27 | 0.37 |
| | 47.5 | 1.5 | | | | | | 1 | | | | 50 | 2.5 | | | | | | | | | | | 0.47 | 0.36 |
| | 47.5 | 1.5 | | | | | | 1 | | | | 50 | | | 2.5 | | | | | | | | | 0.42 | 0.32 |
| | 47.5 | 1.5 | | | | | | 1 | | | | 50 | | | | 2.5 | | | | | | | | 0.50 | 0.38 |
| | 47.5 | | | 1 | | | | 1.5 | | | | 47.5 | 1.5 | | 1 | | | | | | | | | 0.63 | 1.04 |
| | 47.5 | 2.5 | | | | | | | | | | 50 | | | | | | | | | | | | 10.2 | 0.23 |
| | 47.5 | | | 2.5 | | | | | | | | 50 | | | | | | | | | | | | 15.6 | 1.15 |

| | Composition (at.%) | | | | | | | | | | | | | | | | | | | | | | | Corrosion Rate (mm/year) | |
|---|---|---|---|---|---|---|---|---|---|---|---|---|---|---|---|---|---|---|---|---|---|---|---|---|---|
| | Ni | Ta | Nb | W | V | Hf | Mn | Mo | Cr | Fe | Co | Ti | Al | Zr | Mg | Be | Pf | Pd | Rh | Ir | Os | Ru | | 40% $H_2SO_4$ | 33% $HNO_3$ |
| Inventive Materials | 47.5 | 2 | | | | | | | | | | 50 | | | | | 0.5 | | | | | | | 0.02 | 0.27 |
| | 47.5 | 2 | | | | | | | | | | 50 | | | | | | 0.5 | | | | | | 0.03 | 0.30 |
| | 47.8 | 2 | | | | | | | | | | 50 | | | | | | | 0.2 | | | | | 0.05 | 0.34 |
| | 47.8 | 2 | | | | | | | | | | 50 | | | | | | | | 0.2 | | | | 0.04 | 0.31 |
| | 47.8 | 2 | | | | | | | | | | 50 | | | | | | | | | 0.2 | | | 0.06 | 0.29 |
| | 47.8 | 2 | | | | | | | | | | 50 | | | | | | | | | | 0.2 | | 0.05 | 0.28 |
| Conventional Materials | Stainless steel (AISI Type 302) | | | | | | | | | | | | | | | | | | | | | | | 79.4 | 0.56 |
| | Stellite | | | | | | | | | | | | | | | | | | | | | | | | |
| | 50 at% Ni - 50 at% Ti | | | | | | | | | | | | | | | | | | | | | | | 107.6 | 7.38 |
| | 53 at% Ni - 47 at% Ti | | | | | | | | | | | | | | | | | | | | | | | 98.4 | 6.95 |
| | 48 at% Ni - 52 at% Ti | | | | | | | | | | | | | | | | | | | | | | | 112.7 | 7.97 |
| | 35 at% Ni - 15 at% Fe - 50 at% Ti | | | | | | | | | | | | | | | | | | | | | | | 124.5 | 10.02 |
| | 47.5 at% Ni - 2.5 at% Cr - 50 at% Ti | | | | | | | | | | | | | | | | | | | | | | | 87.9 | 3.93 |

What is claimed is:

1. An erosion-resistant and wear-resistant Ti-Ni-$M_1$-$M_2$ alloy consisting essentially of 42.5 to 54.4 atomic percent of Ti, in which $M_1$ is Ta or Nb and $M_2$ is Mo, and the atomic ratio of $M_1 + M_2$ to the total atoms other than Ti is 1 to 55%.

2. An erosion — resistant and wear-resistant Ti-Ni-$M_1$-$M_2$ alloy consisting essentially of 47–52 atomic percent of Ti, in which $M_1$ is Ta or Nb and $M_2$ is Mo, and the atomic ratio of $M_1 + M_2$ to the total atoms other than Ti is 1 to 35%.

3. An erosion — resistant and wear — resistant Ti-Ni-$M_1$-$M_2$ alloy consisting essentially of 48 to 51 atomic percent of Ti, in which $M_1$ it Ta or $N_b$ and $M_2$ is Mo, and the atomic ratio of $M_1 + M_2$ to the total atoms other than Ti is 1 to 25%.

* * * * *